United States Patent [19]

Nakahara et al.

[11] Patent Number: 5,054,300

[45] Date of Patent: Oct. 8, 1991

[54] VEHICLE DOOR LOCK SYSTEM

[75] Inventors: Kazumi Nakahara; Mikio Honma; Fumio Kobayashi, all of Yokohama, Japan

[73] Assignee: Ohi Seisakusho Co., Ltd., Yokohama, Japan

[21] Appl. No.: 432,904

[22] Filed: Nov. 7, 1989

[30] Foreign Application Priority Data

Nov. 9, 1988 [JP] Japan ..... 63-281428
Dec. 29, 1988 [JP] Japan ..... 63-331108

[51] Int. Cl.[5] ..... E05B 53/00
[52] U.S. Cl. ..... 70/262; 70/264
[58] Field of Search ..... 70/262–264

[56] References Cited

U.S. PATENT DOCUMENTS

| | | | |
|---|---|---|---|
| 2,254,419 | 9/1941 | Castle | 70/262 X |
| 2,672,943 | 3/1954 | Chatlynne et al. | 70/262 X |
| 2,690,481 | 9/1954 | Courtney | 70/262 X |
| 2,804,159 | 8/1957 | Gavito | 70/264 X |
| 3,247,924 | 4/1966 | Price | 70/263 X |
| 3,288,524 | 11/1966 | Gordon | 70/264 X |
| 3,435,645 | 4/1969 | Gallo | 70/263 X |
| 3,543,546 | 12/1970 | Gallo | 70/264 |
| 4,419,712 | 12/1983 | Shimizu et al. | 70/262 X |

FOREIGN PATENT DOCUMENTS

| | | | |
|---|---|---|---|
| 1177974 | 9/1964 | Fed. Rep. of Germany | 70/263 |
| 3032804 | 4/1982 | Fed. Rep. of Germany | 70/264 |
| 3425108 | 10/1985 | Fed. Rep. of Germany | 70/264 |
| 3636828 | 5/1987 | Fed. Rep. of Germany . | |
| 3611883 | 10/1987 | Fed. Rep. of Germany | 70/264 |
| 3625833 | 2/1988 | Fed. Rep. of Germany . | |
| 2034802 | 6/1980 | United Kingdom | 70/263 |
| 2129044 | 5/1984 | United Kingdom | 70/264 |

*Primary Examiner*—Gary L. Smith
*Assistant Examiner*—Suzanne L. Dino
*Attorney, Agent, or Firm*—Foley & Lardner

[57] ABSTRACT

A vehicle door lock system including a power lock actuator for locking and unlocking a door by moving a lock lever, is further provided with a childproof and theftproof lock actuator for moving a block lever between a block position to prevent the swing motion of the lock lever, and an unblock position to allow the lock lever's swing motion.

19 Claims, 10 Drawing Sheets

VEHICLE DOOR LOCK SYSTEM

BACKGROUND OF THE INVENTION

The present invention relates to a door lock system for a vehicle such as a motor vehicle, and more specifically to a vehicle door lock system having a childproof and/or theftproof lock mechanism.

A conventional childproof lock mechanism, which is generally provided in a rear door of a vehicle, is constructed so that it can be brought into and out of the childproof lock state by opening the door and manually operating a lever projecting from the end of the door.

In a conventional power lock system, on the other hand, it is possible to move its lock lever by applying an external force. Therefore, safety against theft is still unsatisfactory.

SUMMARY OF THE INVENTION

It is therefore an object of the present invention to provide a vehicle door lock system which is easy to operate, and safe for children or from theft.

According to the present invention, a vehicle door lock system comprises a lock means for locking and unlocking a door of a vehicle, and a safety means. The lock means is movable between a lock position to lock the door, and an unlock position to unlock the door. The safety means is movable between a block position and an unblock position. The safety means prevents the lock means from moving from the lock position to the unlock position when it is in the block position, and allows the lock means to move from the lock position to the unlock position when it is in the unblock position.

Preferably, the lock means comprises a lock member and a lock actuator for moving the lock member between the lock and unlock positions, the safety means comprises a block member and a block actuator for moving the block member between the block and unblock positions, and the door lock system further comprises a switch means for producing signals to operate the lock and block actuators.

BRIEF DESCRIPTION OF THE DRAWINGS

FIG. 1 is a schematic perspective view of a vehicle equipped with a door lock system of the first embodiment.

FIG. 2 is a sectional view of a power lock actuator.

FIG. 3 is a sectional view of a safety block actuator.

FIGS. 4 and 5 are side views showing the arrangement of the power lock and safety block actuators in different states.

FIG. 6 is a diagram showing a door lock control circuit of the first embodiment.

FIG. 7 is a schematic perspective view of a vehicle equipped with a door lock system of the second embodiment.

FIG. 8 is a plan view showing a contact plate and a substrate.

FIGS. 9 and 10 are side views showing the arrangement of the power lock actuator and safety block actuator of the second embodiment in different states.

FIG. 11 is a diagram showing a door lock control circuit of the second embodiment.

DETAILED DESCRIPTION OF THE INVENTION

A first embodiment of the invention is shown in FIGS. 1–6.

Figure 1:
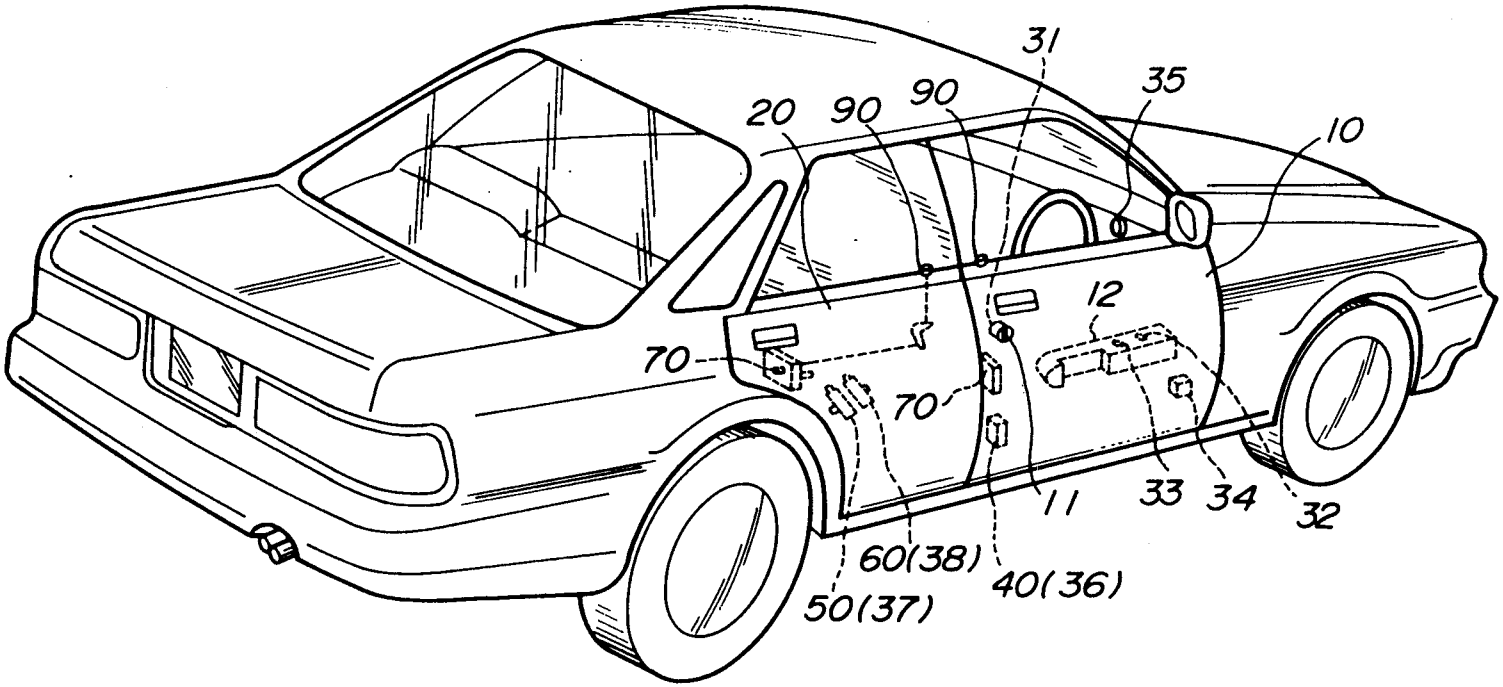
FIGS. 1–6 show a first embodiment of the present invention.

A vehicle shown in FIG. 1 has a driver's side front door 10 and a rear door 20 on the right side. A door lock system of this embodiment includes at least one key cylinder 11, and at least one key operated lock switch 31. The key cylinder 11 shown in FIG. 1 is provided in the driver's door 10 for locking and unlocking the door system of the vehicle by a key from the outside of the vehicle. The key switch 31 is connected with the key cylinder 11, and arranged to produce key lock and key unlock signals when the correct key is inserted and turned in the key cylinder 11.

The door lock system further includes inside hand control switches 32 and 33 provided near the driver's seat inside the vehicle. In this embodiment, the hand control switches 32 and 33 are both mounted on an armrest 12 of the driver's door 10. The hand switch 33 is a power lock switch for locking and unlocking the door system of the vehicle. The hand switch 32 is a safety lock switch for locking the door system in a childproof manner. The lock system of this embodiment further includes an acceleration detector (switch) 34 for producing a signal when an acceleration (deceleration) of the vehicle exceeds a predetermined level, and an ignition key switch 35. The door lock system further includes a latching actuator 40 connected with the key switch 31, and a key operation memory switch 36 operated by the latching actuator 40. The latching actuator 40 and the key operation memory switch 36 serves as a memory means.

Each rear door 20 has a power lock actuator 50 for locking the door in an ordinary manner, and a safety block actuator 60 for locking the door in a childproof and theftproof manner. Each lock actuator 50 has a door lock detector (switch) 37, and each safety block actuator 60 has a block detector (switch) 38. Each rear door has a door lock unit 70, and a lock knob 90 for manually locking and unlocking the door from the inside of the vehicle.

Figure 2:
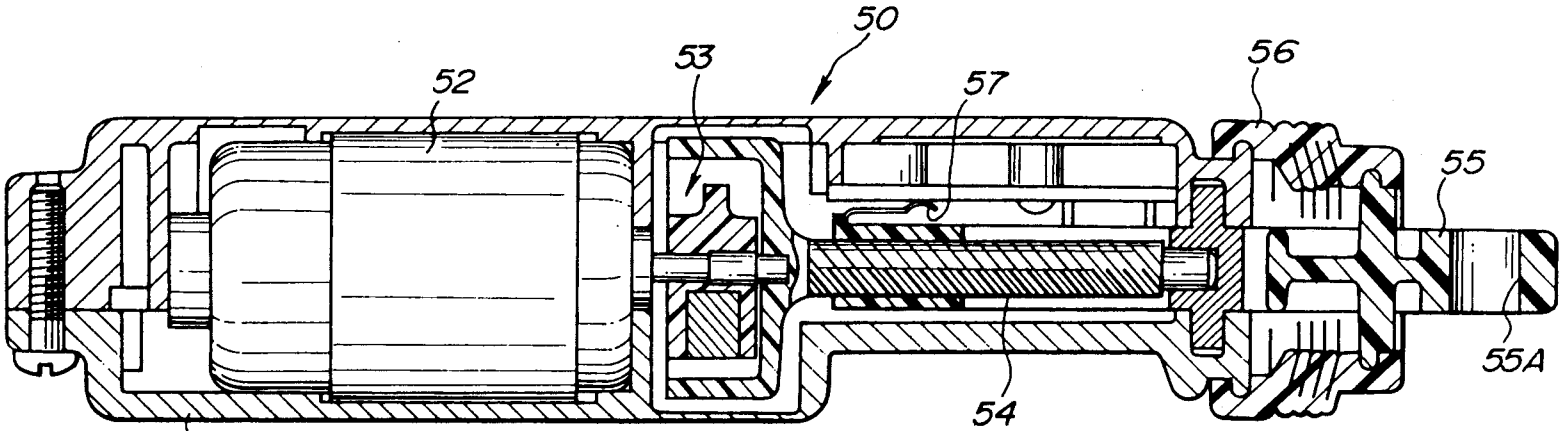

As shown in FIG. 2, the lock actuator 50 of each rear door has a motor 52, a centrifugal clutch 53, a rotating screw member 54 and an operating rod 55, which are all enclosed in a housing 51. The screw member 54 is driven by the motor 52 through the centrifugal clutch 53. The operating rod 55 is engaged with the screw 54, and driven by the screw member 54 so that the operating rod 55 can project and retract with respect to the housing 51. The pitch angle (or lead angle) of the screw thread of the screw member 54 is so great that it is possible to rotate the screw member 54 by moving the operating rod 55. A dust protective boot 56 is provided between the operating rod 55 and the housing 51. A contact member 57 which is a constituent of the lock detector 37 is fixed to an inner end portion of the operating rod 55. An engagement hole 55A is formed in an outer end portion of the operating rod 55. Between the inner and outer end portions of the operating rod 55, there is formed a relatively long rectangular opening into which the screw 54 entends through an internally threaded hole formed in the inner end portion. A similar actuator is shown in U.S. patent application Ser. No. 07/344,379, filed Apr. 28, 1989, and British Patent Application No. 8910810.4, filed May 11, 1989.

Figure 3:
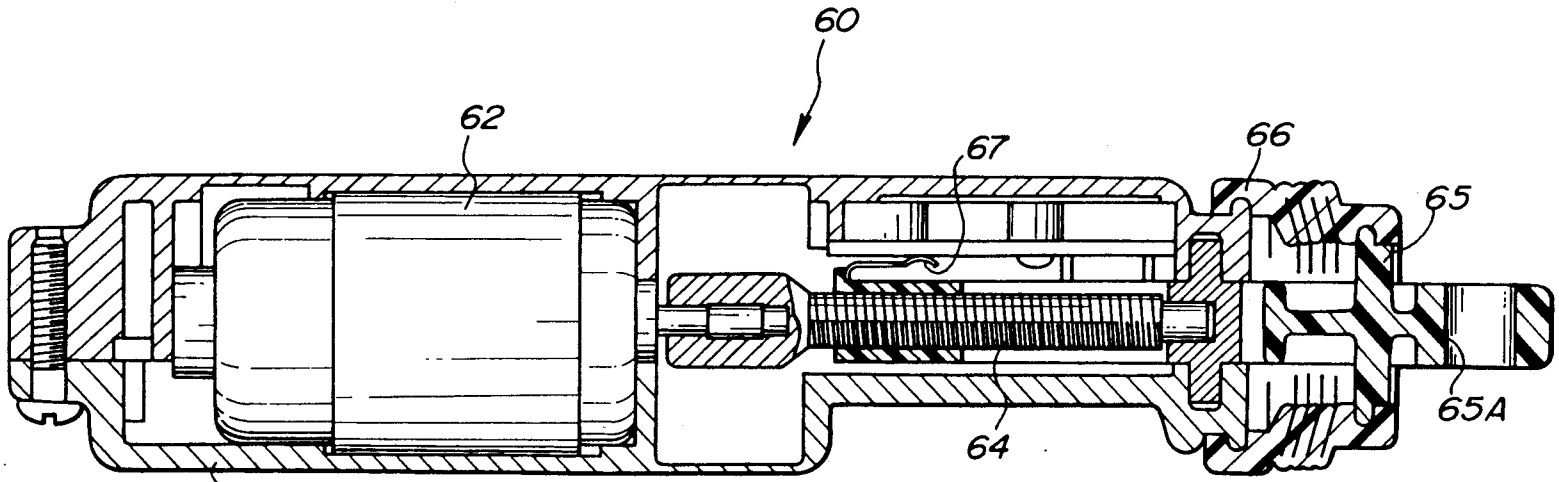

As shown in FIG. 3, the block actuator 60 is substantially identical in construction to the lock actuator 50 except that the block actuator 60 has no centrifugal clutch. The block actuator 60 has a motor 62, a rotating screw member 64 directly driven by the motor 62, and an operating rod 64, which are all enclosed in a housing 61. A dust protective boot 66 is between the operating rod 65 and the housing 61. A contact member 67 of the block detector 38 is fixed to the inner end portion of the operating rod 65. The outer end portion of the operating rod 65 is formed with an engagement hole 65A. The operating rod 65 has a rectangular opening between the inner and outer end portions.

Figure 4:
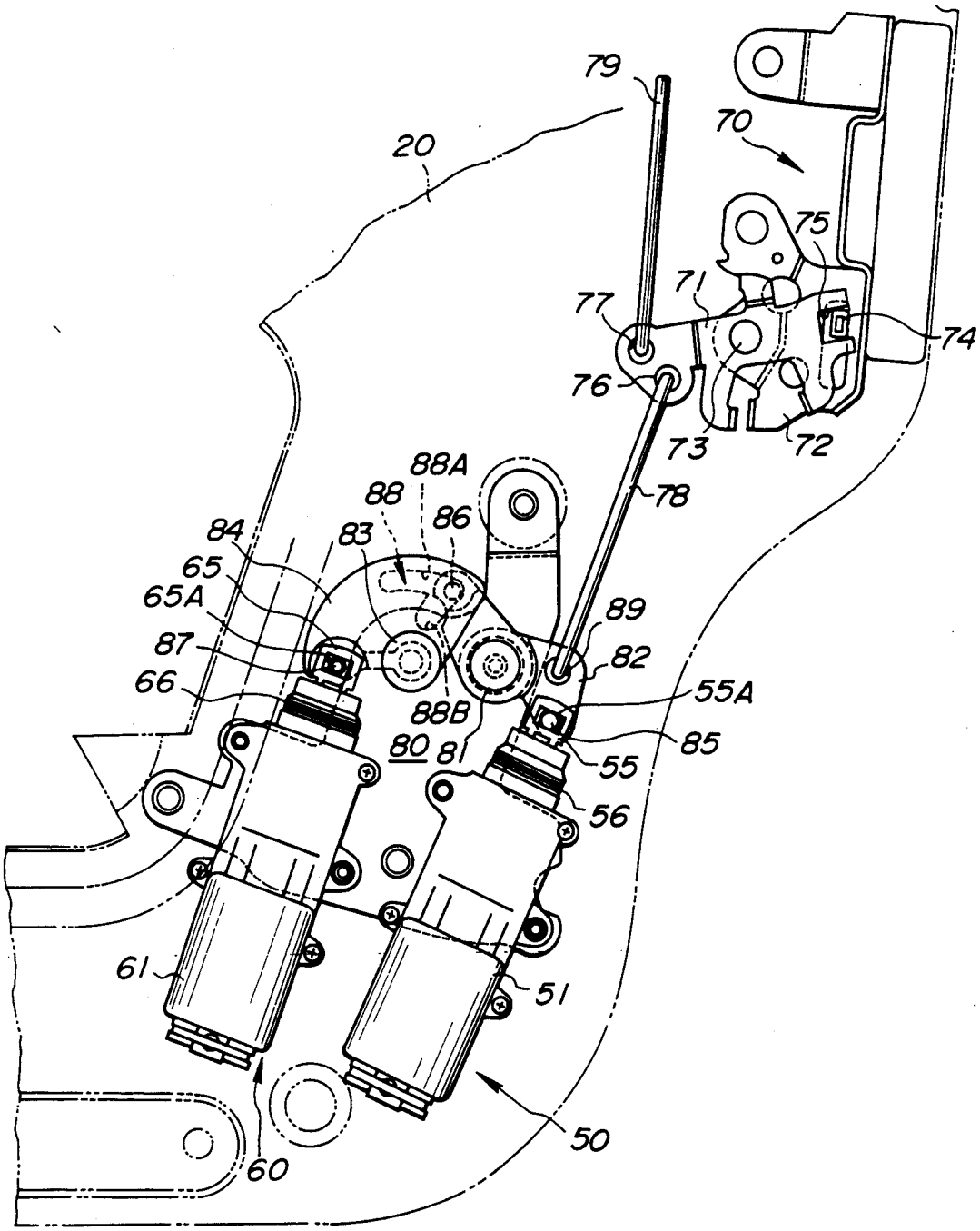

The lock actuator 50, the block actuator 60 and the door lock unit 70 of each rear door are linked with one another as shown in FIG. 4.

The lock and block actuators 50 and 60 are arranged approximately in parallel to each other as shown in FIG. 4, and fixed to the rear door 20 through a mounting bracket 80.

A power lock lever 82 and a safety block lever 84 are mounted on the mounting bracket 80. The power lock lever 84 is swingable on a first (lock) swing axis 81, and the safety block lever 84 is swingable on a second (block) swing axis 83. A first engagement pin 85 is fixed to a first end of the lock lever 82, and a second engagement pin 86 is fixed to a second end of the lock lever 82. The first engagement pin 85 is engaged in the engagement hole 55A of the operating rod 55 of the lock actuator 50.

An engagement pin 87 is fixed to a first end of the block lever 84, and an engagement slot 88 is formed in a second end of the block lever 84. The block lever 84 is connected with the block actuator 60 through the engagement pin 87 which is engaged in the engagement hole 65A of the operating rod 65 of the block actuator 60. The second engagement pin 86 of the lock lever 82 is engaged in the slot 88 of the block lever 84. The engagement slot 88 includes two arc slot sections 88A and 88B. The arc section 88A is elongated so as to draw an arc of a circle whose center lies on the block swing axis 83, and the arc section 88B is elongated so as to draw an arc of a circle whose center lies on the lock swing axis 81 when the block lever 84 is in the position shown in FIG. 4. The arc sections 88A and 88B are connected end to end. The lock lever 82 is further formed with an engagement hole 89.

The lock unit 70 of a known type is mounted at the end of the rear door 20. The lock unit 70 has a knob lock lever 71 which is swingable about a swing axis 73 fixed to a bracket 72. The knob lock lever 71 has a first end which is formed with an engagement notch 75 engaged with a latch stopper 74, and a second end which is formed with first and second engagement holes 76 and 77. The knob lock lever 71 is connected with the power lock lever 82 by a connecting rod 78. One end of the connecting rod 78 is engaged with the engagement hole 76 of the knob lock lever 71, and the other end of the connecting rod 78 is engaged with the engagement hole 89 of the power lock lever 82. The knob lock lever 71 is further connected with the lock knob 90 by connecting rods including a connecting rod 79 whose end is engaged with the engagement hole 77, and one or more bell cranks.

Figure 6:
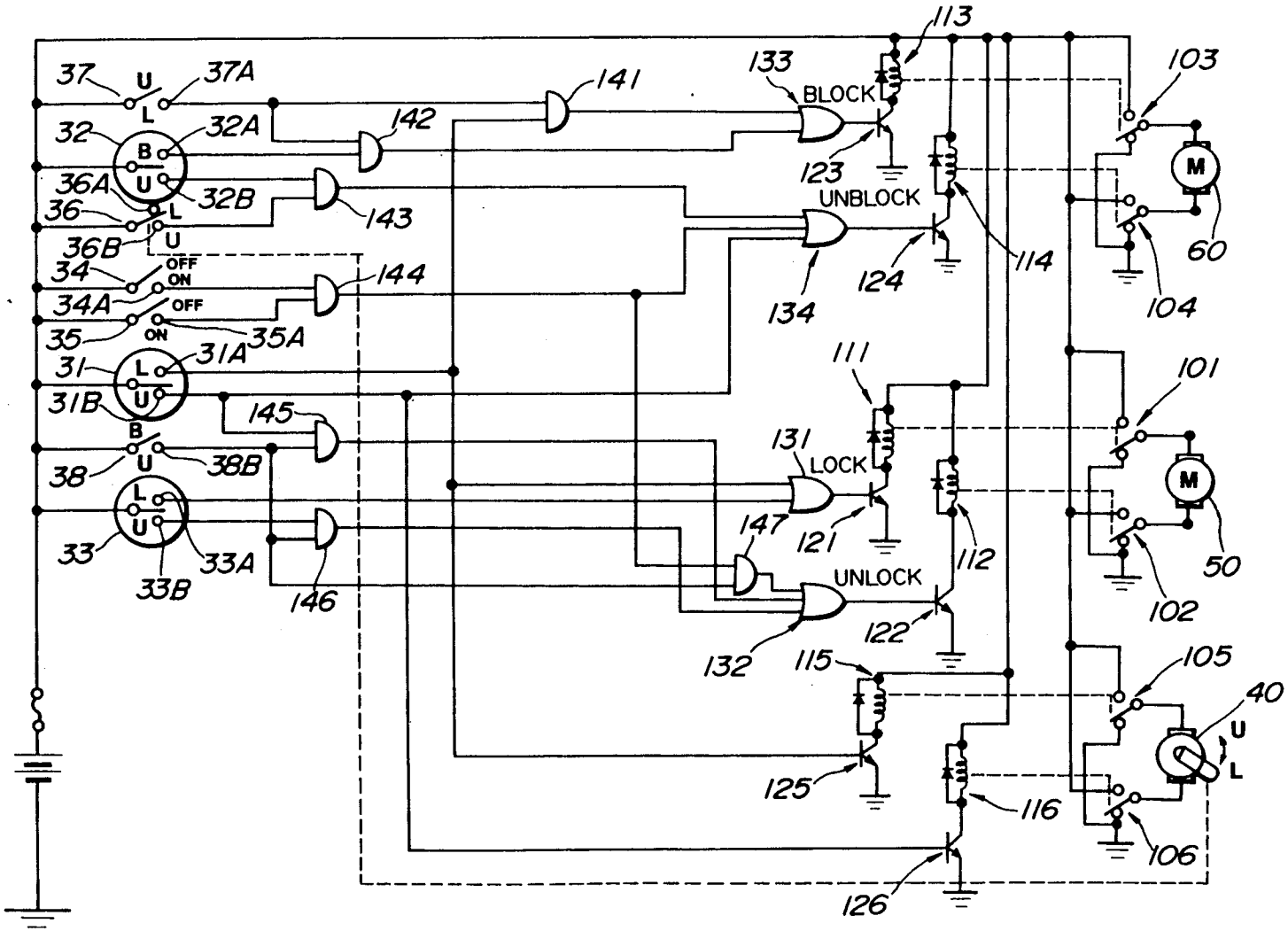

FIG. 6 shows a door lock control circuit of the first embodiment for each rear door. The door lock control circuit includes first and second relay contact sets 101 and 102 which are connected with the lock actuator 50, third and fourth relay contact sets 103 and 104 which are connected with the block actuator 60, and fifth and sixth relay contact sets 105 and 106 which are connected with the latching actuator 40. These six relay contact sets 101–106 are actuated, respectively, by first, second . . . and sixth relays 111–116. The six relays 111 through 116 are connected, respectively, with first, second . . . and sixth switching transistors 121 through 126. Base terminals of the first through fourth switching transistors 121–124 are connected with output terminals of first, second, third and fourth OR gates 131–134.

The control circuit further includes seven AND gates 141–147, each of which has two input terminals and one output terminal.

The first AND gate 141 (first logic means) has a first input terminal which is connected with a lock side terminal 37A of the lock detector switch 37, and a second input terminal which is connected with a lock side terminal 31A of the key switch 31. The output terminal of the first AND gate 141 is connected with a first input terminal of the third OR gate 133.

The second AND gate 142 (fourth logic means) has a first input terminal which is connected with the lock side terminal 37A of the lock detector switch 37, and a second input terminal which is connected with a block side terminal 32A of the safety lock switch 32. The output terminal of the second AND gate 142 is connected with a second input terminal of the third OR gate 133.

The third AND gate 143 (fifth logic means) has a first input terminal which is connected with an unblock side terminal 32B of the safety lock switch 32, and a second input terminal which is connected with an unlock side terminal 36B of the key operation memory switch 36. The output terminal of the third AND gate 143 is connected with a first input terminal of the fourth OR gate 134.

The fourth AND gate 144 has a first input terminal which is connected with an ON terminal 34A of the acceleration detector switch 34, and a second input terminal which is connected with an ON terminal 35A of the ignition key switch 35. The output terminal of the fourth AND gate 144 is connected with a second input terminal of the fourth OR gate 134, and a first input terminal of the seventh AND gate 147.

The fifth AND gate 145 (second logic means) has a first input terminal which is connected with an unlock side terminal 31B of the key lock switch 31, and a second input terminal which is connected with an unblock side terminal 38B of the block detector switch 38. The output terminal of the fifth AND gate 145 is connected with a second input terminal of the second OR gate 132.

The sixth AND gate 146 (third logic means) has a first input terminal which is connected with an unlock side terminal 33B of the power lock switch 33, and a second input terminal which is connected with an unblock side terminal 38B of the block detector switch 38. The output terminal is connected with a third input terminal of the second OR gate 132.

The seventh AND gate 147 has a second input terminal which is connected with the unblock side terminal 38B of the block detector switch 38. The first input terminal of the seventh AND gate 147 is connected with the output terminal of the fourth AND gate 144, and the output terminal is connected with a first input terminal of the second OR gate 132.

The first OR gate 131 has a first input terminal which is connected with the lock side terminal 31A of the key switch 31, and a second input terminal which is connected with the lock side terminal 33A of the power lock switch 33. The fourth OR gate 134 has a third input terminal which is connected with the unlock side terminal 31B of the key switch 31.

The door lock system of the first embodiment is operated as follows:

When the driver turns or pushes the power lock switch 33 to the lock side, then the first OR gate 131 produces an ON signal in response to the signal of the power lock switch 33, and energizes the first relay 111 by turning on the first switching transistor 121. Therefore, the first relay contact set 101 is turned on, and the motor 52 of the lock actuator 50 rotates in a lock direction and causes the operating rod 55 to retract. The retraction of the operating rod 55 causes the power lock lever 82 to rotate in a clockwise direction as viewed in FIG. 4, and to move the lock lever 71 of the lock unit 70 to the lock position, through the connecting rod 78. At the same time, the lock actuator 50 pulls down the lock knob 90 to the lock position, through the connecting rod 79. The thus-obtained door lock state is shown in FIG. 4.

When the driver further operates the safety lock switch 32 to the block side, then the second AND gate 142 receives the ON signals from both the safety lock switch 32, and the lock detector switch 37 which holds a connection to the lock side terminal 37A that has been closed as the result of the lock operation of the lock actuator 50. Therefore, the second AND gate 142 turns on the third switching transistor 123 by sending the signal through the third OR gate 133, and starts the block actuator 60 performing a block operation by energizying the third relay 113 and switching on the third relay contact set 103. The block actuator 60 projects the operating rod 65 by rotating the motor 62, and rotates the block lever 84 about the second swing axis 83 in the clockwise direction as viewed in FIG. 4. During this clockwise rotation of the block lever 84, the engagement pin 86 of the power lock lever 82 slides along the arc slot section 88A until it reaches an innermost end of the arc section 88A. Thus, the door lock system reaches a safety lock state shown in FIG. 5.

Figure 5:
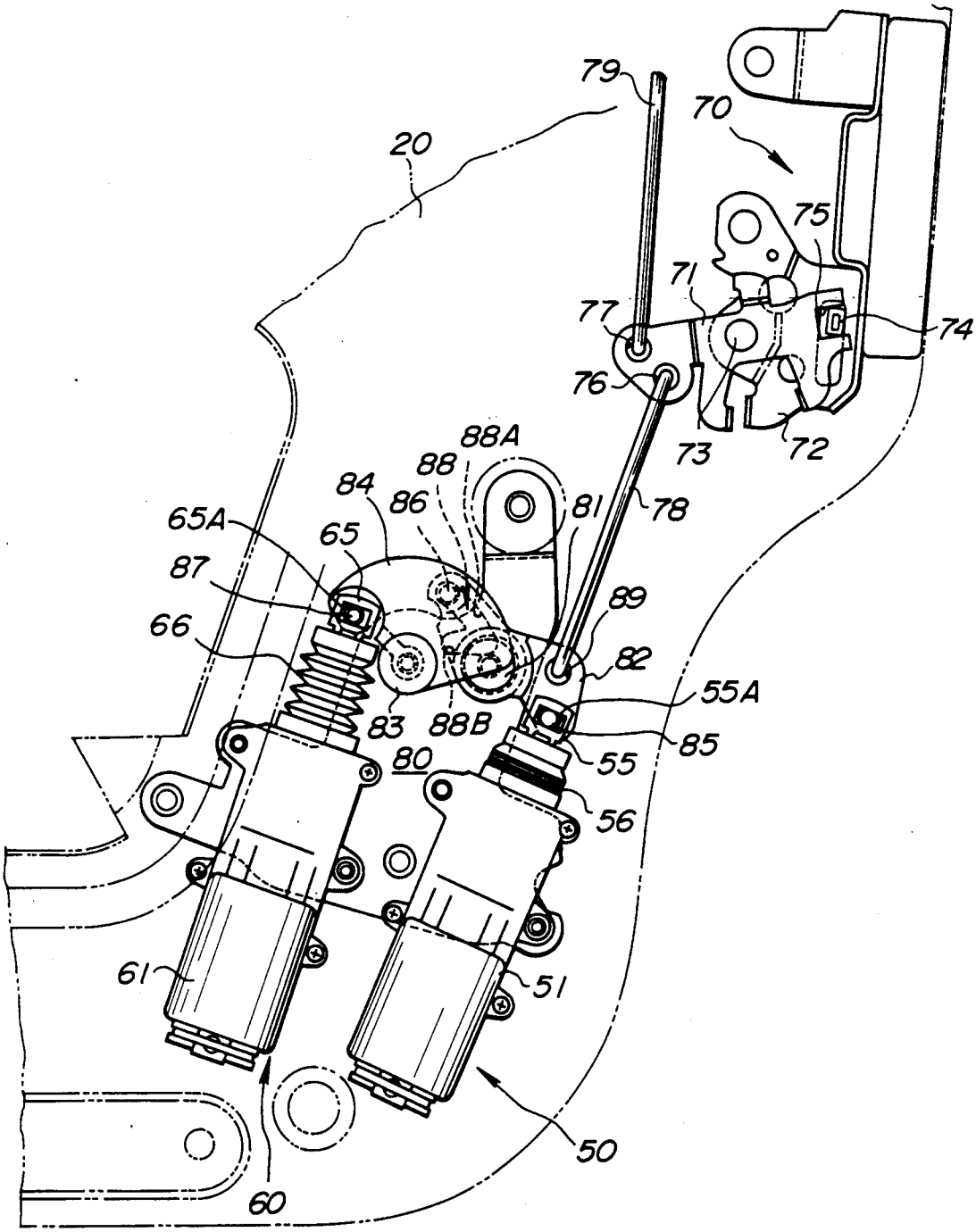

In the safety lock state shown in FIG. 5, the block lever 84 makes the power lock lever 82 unable to rotate by blocking the swing motion of the engagement pin 86 of the power lock lever 82 with the side walls of the arc slot section 88A. Therefore, it is not possible to unlock the door by operating the lock knob 90 or the inside handle. In this state, it is not possible, either, to open the door from the outside by operating the outside door handle.

In the ordinary lock state shown in FIG. 4, it is possible to unlock the door by manually operating the inside lock knob 90 and rotating the lock lever 71 in the clockwise direction. During this clockwise rotation of the lock lever 71, the power lock lever 82 is allowed to rotate in the counterclockwise direction about the first swing axis 81 because the engagement pin 86 of the power lock lever 82 can swing about the first swing axis 81 in the arc slot section 88B. In this state, the centrifugal clutch 53 of the lock actuator 50 is disengaged, so that the operating rod 55 can be pulled out smoothly without resistance by operating the lock knob 90.

It is possible for the driver to cancel the safety lock by operating the safety lock switch 32 to the unblock side. In this case, the third AND gate 143 receives not only the ON signal from the safety lock switch 32, but also the ON signal from the key operation memory switch 36 because the latching actuator 40 11 is in the unlock position and the unlock side terminal 36B is closed. Therefore, the third AND gate 143 sends the ON signal to the fourth OR gate 134, the fourth OR gate 134 turns on the switching transistor 124, and the switching transistor 124 energizes the fourth relay 114, and switches the fourth relay contact set 104 to the position to drive the motor 62 of the safety block actuator 60 in the reverse direction. The motor 62 rotates in the reverse direction, and causes the block lever 84 to rotate in the counterclockwise direction in FIG. 5 to the unblock position shown in FIG. 4.

If a collision of the vehicle takes place by accident in the safety lock state, and the acceleration (deceleration) exceeds a predetermined level, then the acceleration detector switch 34 turns on. Therefore, the fourth AND gate 144 receives the ON signals from both the acceleration detector switch 34 and the ignition key switch 35 which is also in the ON state, and sends the ON signal to the second and fourth OR gates 132 and 134. The fourth OR gate 134 switches the fourth relay contact sets 104 by energizing the fourth relay 114 and brings the safety block actuator 60 to the unblock position. The second OR gate 132 switches the second relay contact set 102 by energizing the second relay 112, and brings the lock actuator 50 to the unlock position. In an emergency, the door lock system of this embodiment performs the unblock and unlock operations in this way, and make the door openable from the inside and outside.

When the driver gets out of the vehicle, inserts the key in the key cylinder 11 and turns the key in the locking direciton in the key cylinder 11 to lock the door system, then the key lock switch 31 makes the connection to the lock side terminal 31A, and the fifth switching transistor 125 energizes the fifth relay 105 and brings the latching actuator 40 to the lock position. By this movement of the latching actuator 40, the key operation memory switch 36 is set to the lock side terminal 36A. Therefore, the second input terminal of the third AND gate 143 is put in the OFF state, and the third AND gate 143 is put in the state in which the third AND gate 143 cannot output the ON signal. The connection to the lock side terminal 31A of the key lock switch 31 further causes the first OR gate 131 to output the ON signal, so that the power lock actuator 50 locks the door. When the lock actuator 50 reaches the lock position, then the lock detector switch 37 is switched to the lock side terminal 37A, and sends the ON signal to the first AND gate 141. In response to this signal from the lock detector 37 and the signal from the key lock switch 31, the first AND gate 141 sends the ON signal to the third OR gate 133, which, in turn, brings the safety block actuator 60 to the block position. Thus, the door lock system is put in the safety lock state.

The only way to cancel this safety lock state is to operate the key cylinder 11 with the correct key. Even if the window glass is not fully closed, and the safety lock switch 32 or the power lock switch 33 is pushed to open the door with a stick inserted through the remaining window opening, the third AND gate 143 is in the inoperative state as mentioned before, and the safety block actuator 60 can not be operated. Thus, the lock system of this embodiment makes it impossible to cancel the safety lock state without the key. In the safety lock state, it is not possible to rotate the lock lever 71 because the safety block lever 84 blocks the rotation of the power lock lever 82.

When the driver operates the key cylinder 11 with the key to unlock the door, then the key switch 31 is switched to the unlock side terminal 31B, and the fourth OR gate 134 causes the safety block actuator 60 to move to the unblock position for allowing the unlocking operation. In response to this movement of the block actuator 60, the block detector switch 38 makes the connection to the unblock side terminal 38B, and the fifth AND gate 145 outputs the ON signal. Therefore, the second OR gate 132 causes the lock actuator 50 to unlock the door. Furthermore, the latching actuator 40 is operated to the unlock position, and the key operation momory switch 36 is reset to the unlock position.

FIG. 6 shows the control circuit for one of the left and right rear doors. The control circuit for the other rear door is substantially the same as the circuit of FIG. 6, and both circuits are connected with each other so that the switches 31, 32, 33, 34, 35 and 36 are common to both circuits, and the actuators 50 and 60 of both doors are operated simultaneously. Alternatively, it is possible to employ only one circuit as shown in FIG. 6, and to connect the motors 52 of the lock actuators 50 of the left and right rear doors in parallel to each other between the contact sets 101 and 102, and the motors 62 of the block actuators 60 of the left and right rear doors in parallel to each other between the contact sets 103 and 104. In this case, the lock detector switches 37 of the left and right doors are connected in series so as to send the ON signal to the first and second AND gates 141 and 142 when the lock actuators 50 are both brought to the lock position, and the block detectors 38 of the left and right rear doors are connected in series so as to put the unblock side terminal 38B to the ON state when the block actuators 60 are both brought to the unblock position, or alternatively only one of the left and right doors is provided with the lock detector switch 36 and the block detector switch 38.

It is optional to provide each front door with only the power lock actuator 50 or both the actuators 50 and 60. It is optional to use a digital microcomputer in place of the analog control circuit shown in FIG. 6.

The door lock system of the first embodiment makes it possible for the driver to operate the childproof lock device very easily without stopping the vehicle and without getting off the vehicle. Furthermore, the door lock system of this embodiment can considerably improve safety from theft.

A second embodiment of the present invention is shown in FIGS. 7–11.

Figure 7:
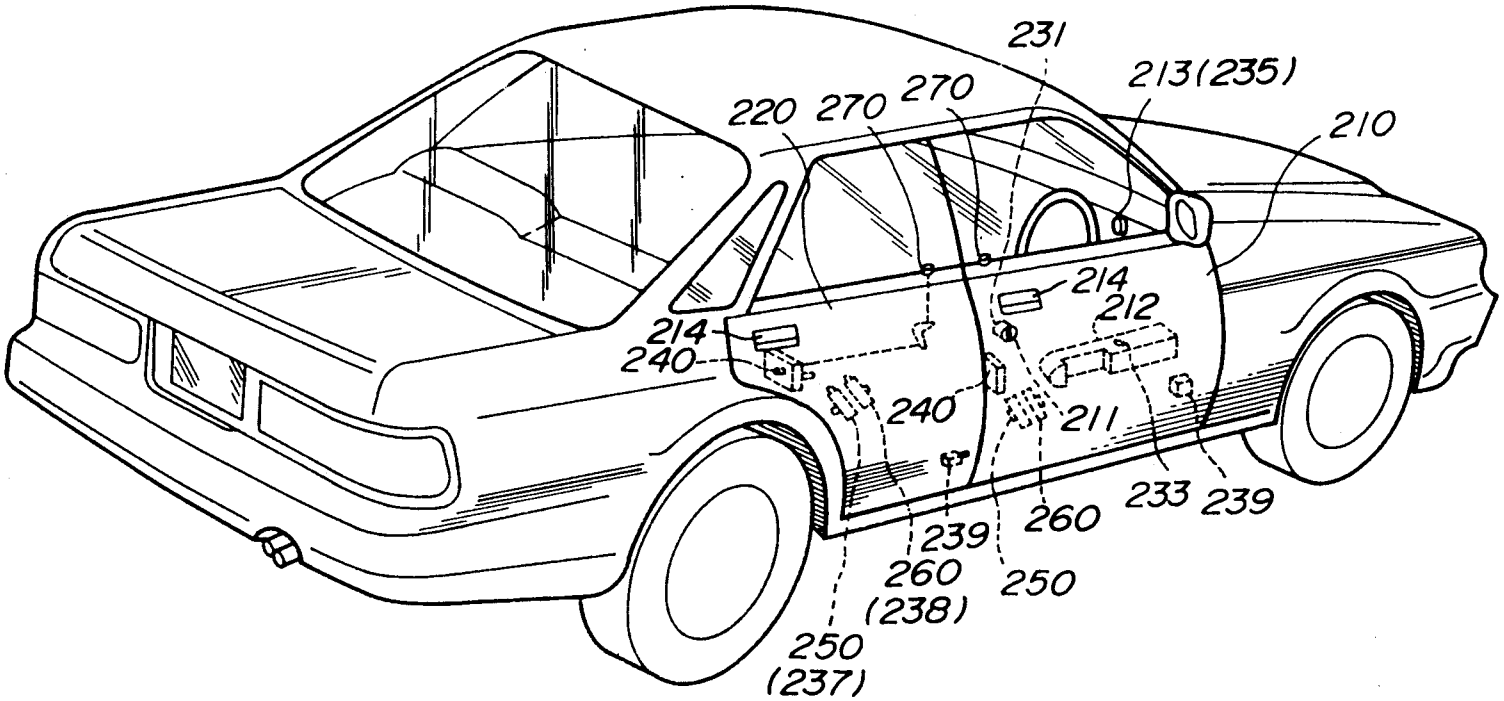
FIGS. 7–11 show a second embodiment.

A vehicle shown in FIG. 7 has a driver's side front door 210 and a rear door 220 on the right side. A door lock system of the second embodiment comprises a key cylinder 211 provided in the front door 210, a key operated switch 231 connected with the key cylinder 211, a power door lock switch 233 provided in the armrest 212 of the driver's door 210, and a key detector switch 235 for detecting whether or not a key is inserted in an ignition key cylinder 213. Each door has an outside handle 214.

Each door has a door lock unit 240 including a lock lever 241, and a lock knob 270 for locking and unlocking the door from the inside. Each door has a power lock actuator 250 and a safety block actuator 260. Each lock actuator 250 has a door lock detector switch 237, and each block actuator 260 has a block detector switch 238. Each door is further equipped with a door position detector switch 239. It is optional to provide one door position switch 239 only in the driver's door.

The lock actuator 250 and the block actuator 260 of the second embodiment are identical in construction to the lock and block actuators shown in FIGS. 2 and 3, respectively. The pitch angle (lead angle) of the screw thread of the screw member 64 of the block actuator 260 is such that the screw member 54 is irreversible whereas the pitch angle of the screw member 54 of the lock actuator 250 is such that the screw member is reversible. Therefore, it is possible to pull up and push down the operating rod 55 by inputting a force to the operating rod 55, but it is not possible to move the operating rod 65 by inputting a force to the operating rod 65.

Figure 8:
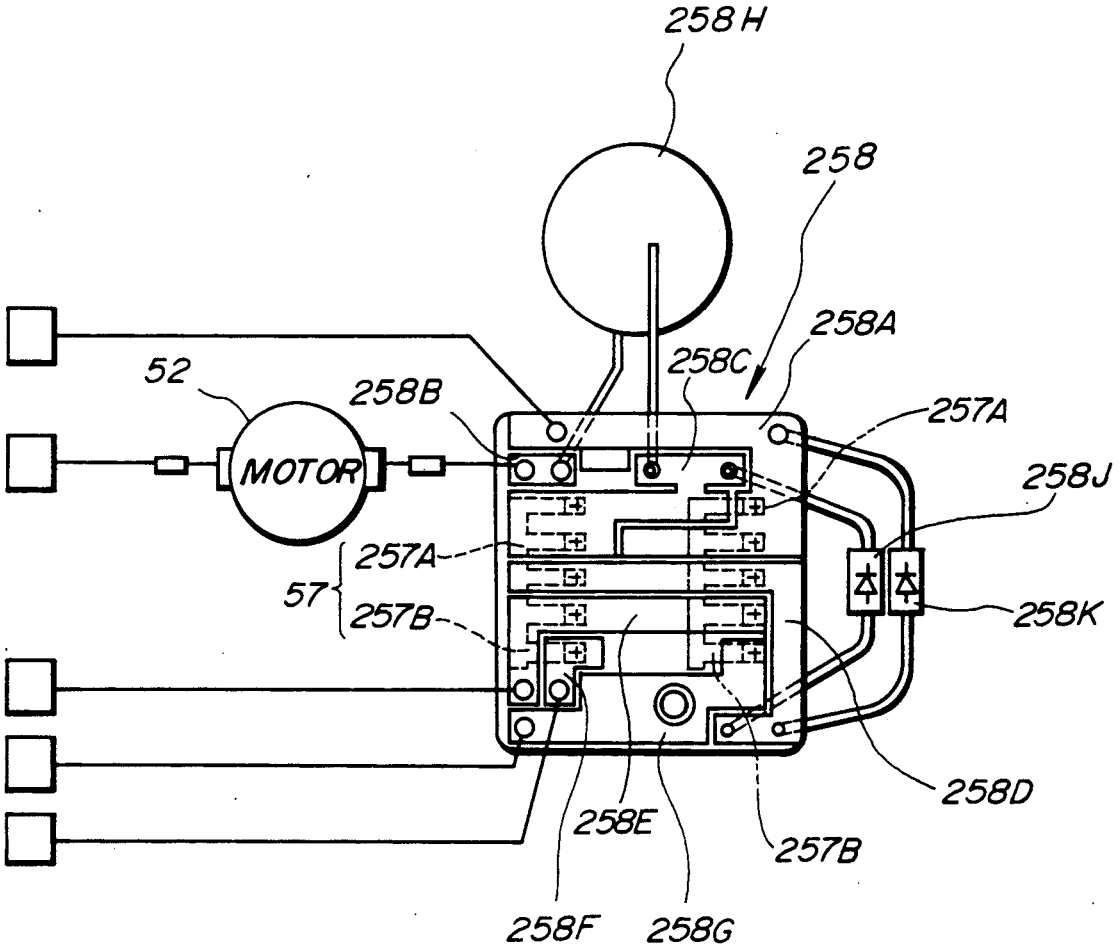

The lock detecter switch 237 has a contact member 57 which is fixed to the inner end portion of the operating rod 55 of the lock actuator 250, and the block detector switch 238 has a contact member 67 which is fixed to the inner end portion of the operating rod 65 of the block actuator 260. A substrate 258 shown in FIG. 8 is provided in the housing 51 of the lock actuator 250. A substrate 268 is provided in the housing 61 of the block actuator 260.

FIG. 8 shows only the contact member 57 and substrate 258. The contact member 67 and substrate 268 are substantially identical to the contact member 57 and substrate 258.

The contact member 57 has a first comblike piece 257A having three contact portions, and a second comblike piece 257B having two contact portions. The contact member 57 is at a left position in FIG. 8 when the operating rod 55 is retracted, and at a right position in FIG. 8 when the operating rod 55 is projected.

The substrate 258 has seven contact plates 258A–258G. The second contact plate 258B is connected with the third contact plate 258C through a thermistor 258H. The third contact plate 258C is connected with the fourth contact plate 258D through a first diode 258J. The fourth contact plate 258D is connected with the first contact plate 258A through a second diode 258K. The first contact plate 258A is connected with a power supply. The second contact plate 258B is connected with one terminal of the motor 52 of the actuator 250.

When the operating rod 55 of the lock actuator 250 is at its retracted position, the first comblike piece 257A connects the third and fourth contact plates 258C and 258D, and the second comblike piece 257B connects the fifth contact plate 258E which is a common terminal, and the sixth contact plate 258F.

When the operating rod 55 is at its projected position, the first comblike piece 257A connects the first and fourth contact plates 258A and 258D, and the second comblike piece 257B connects the fifth and seventh contact plates 258E and 258G. The door lock detector switch 237 is constituted by the second comblike piece 257B, and the fifth, sixth and seventh contact platers 258E, 258F and 258G. The block detector switch 238 of the block actuator 260 is constructed in the same manner.

Figure 9:
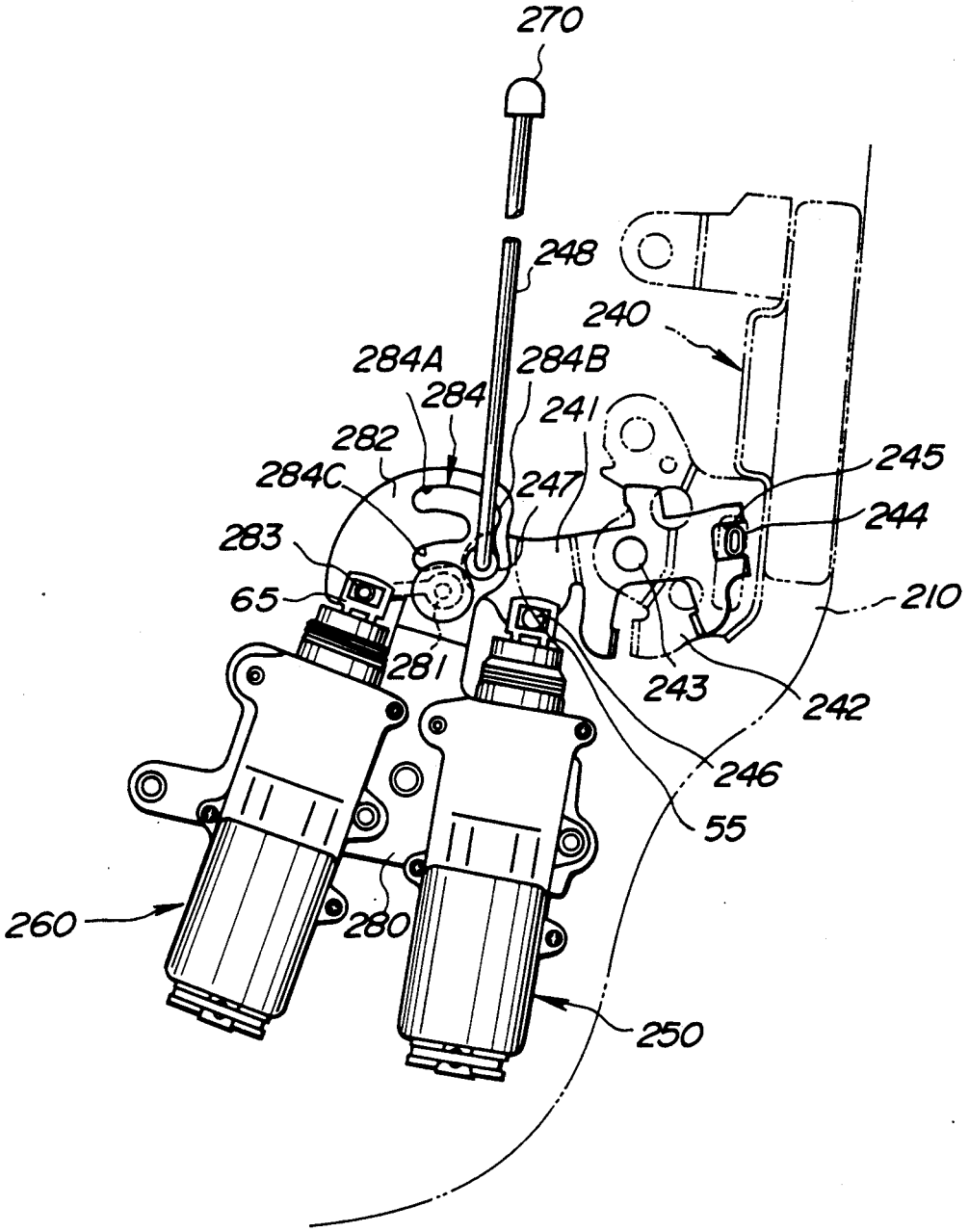

FIG. 9 shows the door lock unit 240, the lock actuator 250 and the block actuator 260 of the driver's side front door 210.

The lock and block actuators 250 and 260 are fixed to the door 210 through a mounting bracket 280.

A block lever 282 is mounted on the bracket 280 so that the block lever 282 can swing on a swing axis 281.

The block lever 282 is connected with the operating rod 65 of the block actuator 260 through a pin 283 which is fixed to a first end of the block lever 282 and which is engaged in the engagement hole 65A of the operating rod 65. The block lever 282 has a second end which is formed with a engagement slot 284, in which a lower end of a connecting rod 248 of the lock knob 270 is slidably received. The engagement slot 284 of the second embodiment has a first arc slot section 284A, a second arc slot section 284B and a third arc slot section 284C, which are connected in series so as to form a U-shaped slot. Each of the first and third slot sections 284A and 284C is elongated so as to draw an arc of a circle whose center lies on the swing axis 281 of the block lever 282. The third section 284C is closer to the axis 281 than the first section 284A. The second arc section 284B is elongated so as to draw an arc of a circle whose center lies on a swing axis 243 of a lock lever 241 when the block lever 282 is at the position shown in FIG. 9. The second arc section 284B extends from the right end of the first arc section 284A to the right end of third arc section 284C.

In the second embodiment, the operating rod 55 of the lock actuator 250 is directly connected with the lock lever 241 of the lock unit 240. The lock lever 241 is swingable on the swing axis 243 fixed to a bracket 242. The lock lever 241 has a first end having a notch 245 engaged with a key lever 244, and a second end having an engagement pin 246 and an engagement hole 247. The engagement pin 246 of the lock lever 241 is engaged in the engagement hole 55A of the operating rod 55 of the lock actuator 250. The lock lever 241 is connected with the lock knob 270 by the connecting rod 248. The lower end of the connecting rod 248 is bent, and inserted in the engagement hole 247 of the lock lever 241, and the engagement slot 284 of the block lever 282.

FIG. 7 shows a door lock control circuit of the second embodiment for the driver's door.

The door lock actuator 250 is connected with a lock relay circuit 301 and an unlock relay circuit 302. The block actuator 260 is connected with a block relay circuit 303 and an unblock relay circuit 304. Each relay circuit has a relay, a relay contact set and a switching transistor as in the circuit shown in FIG. 6. The direction of the current supply to the actuator 250 or 260 is changed by the relay circuits 301 and 302 or 303 and 304 and a changeover switch formed in the substrate 258 or 268.

The control circuit includes two OR gates 331 and 332, and three AND gates 341, 342 and 343.

The first AND gate 341 has a first input terminal connected with a presence side terminal 235A of the key detector switch 235, a second input terminal connected with an opening side terminal 239A of the door position detector switch 239, and an output terminal connected with a first input terminal of the first OR gate 131 which is connected with block relay circuit 303. The key detector switch 235 makes the connection to the presence side terminal 235A when the key is present in the ignition key cylinder 213. The door position detector switch 239 makes the connection to the opening side terminal 239A when the door is open.

The second AND gate 342 has a first input terminal connected with the lock detector switch 237 (which is turned on when the lock actuator 250 is in the lock position), a second input terminal connected with a lock side switch 231A of the key lock switch 231, and an output terminal connected with a second input terminal of the first OR gate 331. The lock side switch 231A of the key lock switch 231 is normally in the off state, and in the on state during the key lock operation.

The third AND gate 343 has a first input terminal connected with an unlock side switch 231B of the key lock switch 231, a second input terminal connected with the block detector switch 238, and an output terminal connected with the unlock relay circuit 302. The unlock side switch 231B is in the off state normally, and in the on state during the key unlock operation. The block detector switch 238 is in the off state when block actuator 260 is in the block position.

The second OR gate 332 has a first input terminal connected with an absence side terminal 235B of the key detector switch 235, a second input terminal connected with the unlock side switch 231B of the key switch 231, and an output terminal connected with the unblock relay circuit 304.

Figure 11:
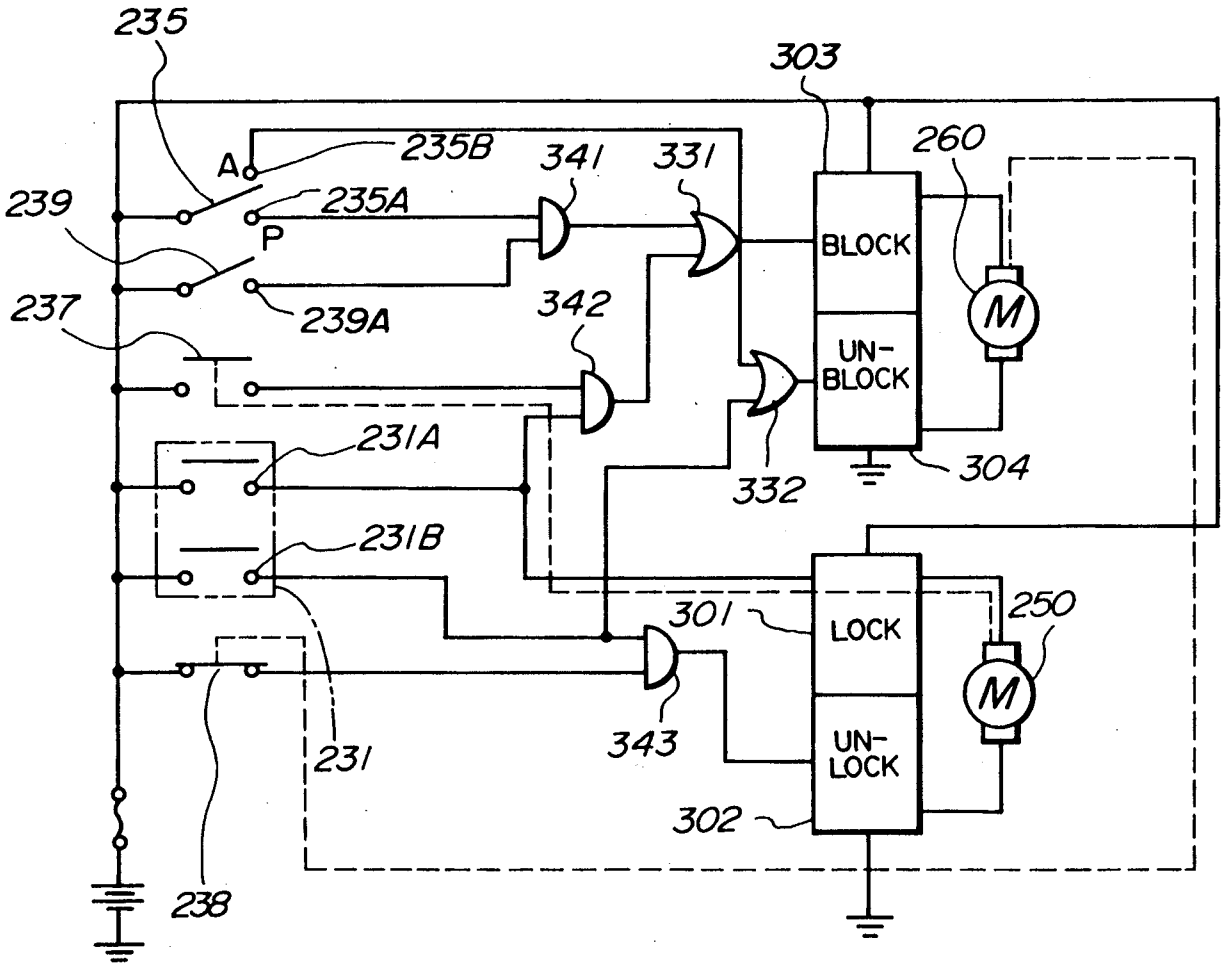

The power lock switch 233, though omitted in FIG. 11, is connected with the lock actuator 250, so that the driver can lock and unlock the door by operating the power lock switch 233.

The door lock system of the second embodiment is operated as follows:

When the door lock unit 240 is in the unlock state, the oprating rod 55 of the door lock actuator 250 is extended, and the second end of the lock lever 241 is lifted up. In this state, the lower end of the connecting rod 248 is located at the intersection between the first and second arc slot sections 284A and 284B.

When the driver opens the driver's door in this unlock state, then the door position detector switch 239 closes the opening side terminal 239A. If the key is left behind in the key cylinder 213, then the key detector switch 235 holds the connection to the presence side terminal 235A. Therefore, the first AND gate 341 receives the ON signals from the switches 235 and 239, and actuates the block relay circuit 303 by sending the signal through the first OR gate 331. Consequently, the block actuator 260 projects the operating rod 65 by rotating the motor 62, and rotates the block lever 282 in the clockwise direction about the swing axis 281. During this rotation, the lower end of the connecting rod 248 slides in the first arc section 284A and reaches the innermost end of the first arc section 284A.

In this block state, the block lever 282 disables a keyless lock operation by blocking the swing motion of the lock lever 241. Therefore, the driver cannot push down the lock knob, and becomes aware of the key left behind in the ignition key cylinder 213.

When the driver pulls out the key from the ignition key cylinder 213, the key detector switch 235 makes the connection to the absence side terminal 235B momentarily, and the second OR gate 332 actuates the unblock relay circuit 304. Therefore, the block actuator 260 retracts the operating rod 65, and rotates the block lever 282 about the axis 281 in the counterclockwise direction. Thus, the keyless lock becomes possible.

When the driver pushes down the lock knob 270 to effect the keyless lock, the lower end of the connecting rod 248 moves downwards along the second arc slot section 284B together with the second end of the lock lever 241. During this, the operating rod 55 of the lock actuator 250 is pushed down by the lock lever 241, and retracts by rotating the screw member 54 whose pitch angle is so great as to allow the reversible motion. The screw member 54 is disengaged from the motor 52 by the centrifugal clutch 54, so that the manual operation of the lock knob 270 is smooth and easy.

It is also possible to lock the door by using the key. When the key is inserted and turned in the key cylinder 211 to lock the door, then the key lock switch 231 turns on the lock side switch 231A, and energizes the relay of the lock relay circuit 301. At this time, the operating rod 55 of the lock actuator 250 is still in the projected position, and the contact member 257 is in the right position in FIG. 8, in which the first comblike piece 257A makes the connection between the first contact plate 258A and the fourth contact plate 258D. Therefore, the current flows from the relay through the first contact plate 258A, the fourth contact plate 258D, the first diode 258J, the third contact plate 258C, the thermistor 258H and the second contact plate 258B, and causes the motor 52 to rotate in the lock direction to retract the operating rod 55. Thus, the lock actuator 250 rotates the lock lever 241 in the counterclockwise direction in FIG. 5 until the lock position is reached, and pulls down the lock knob 270 through the connecting rod 248. FIG. 5 shows the thus-obtained door lock state.

Figure 10:
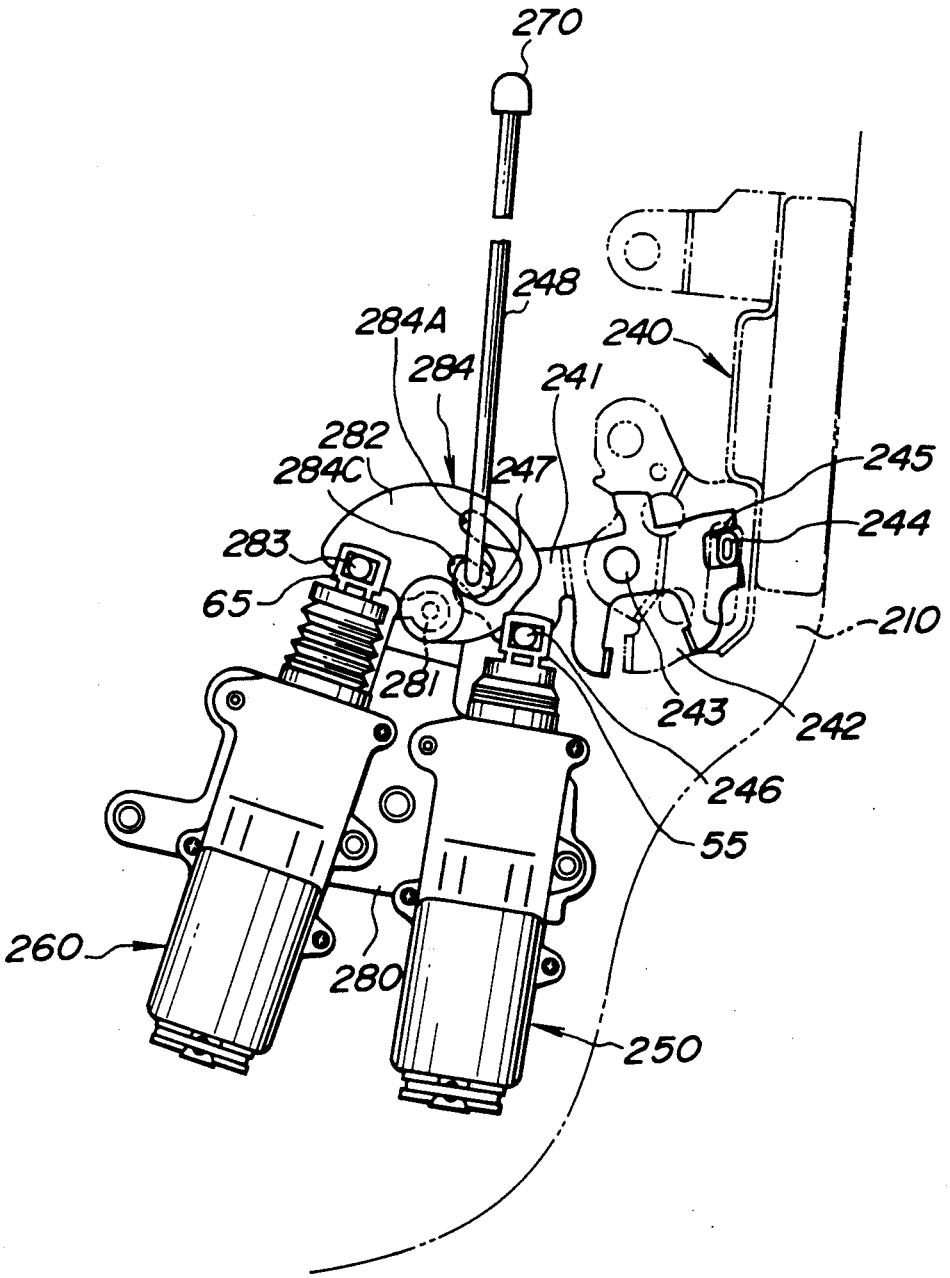

When the lock actuator 250 reaches the lock position, then the contact member 257 moves to the left position shown in FIG. 10, and the second contact piece 257B connects the fifth and sixth contact plates 258E and 258F, so that the lock detector switch 237 turns on. Therefore, both input terminals of the second AND gates 342 are energized by the output signals of the lock side switch 231A of the key lock switch 231, and the lock detector switch 237. The second AND date 342 energizes the relay of the block relay circuit 303 through the first OR gate 331, and causes the block actuator 260 to rotate the block lever 282 in the counterclockwise direction by extending the operating rod 65. During this, the lower end of the connecting rod 248 slides along the third arc slot section 284C from the intersection between the second and third sections 284B and 284C, to the innermost end of the third slot section 284C. Thus, the safety lock state shown in FIG. 10 is reached.

It is not possible to cancel this safety lock state without operating the key cylinder 211 with the key. In this safety lock state, the lock lever 241 is made immovable by the block lever 282. The block lever 282 itself is also immovable because the pitch angle (lead angle) of the screw member 64 of the block actuator 260 is so small that the block actuator 260 is irreversible, and the screw member 64 cannot be rotated by an input force applied to the operating rod 65.

When the key is inserted and turned in the key cylinder 211 to unlock the door, then the unlock side switch 231B of the key lock switch 231 is turned on and the second OR gate 332 causes the block actuator 260 to move to the unblock position. When the operating rod 65 of the block actuator 260 reaches the unblock position, then the block detector switch 238 turns on and the third AND gate 343 causes the lock actuator 250 to perform the unlock operation.

It is possible to interconnect the motors of the lock and block actuators 250 and 260 of the four doors in various manners. For example, the door lock control circuits may be arranged so that all the doors can be lock and unlocked simultaneously by operating the power lock switch 233 or the key cylinder 211 of the driver's door.

In the second embodiment, the block actuator 260 is used for preventing the driver from inadvertently lock the door with the key left inside the vehicle. In the arrangement shown in FIG. 9, the operating rod 55 of the lock actuator 250 is directly engaged with the lock lever 241 of the lock unit 240, so that the number of required component parts is reduced, and the operating feeling of the lock knob is improved.

What is claimed is:

1. A vehicle door system comprising:

lock means for locking and unlocking a door of a vehicle, said lock means being movable between a lock position to lock the door and an unlock position to unlock the door; and safety means which prevents said lock means from moving from said lock position to said unlock position when said safety means is in a block position, and which allows said lock means to move from said lock position to said unlock position when said safety means is in an unblock position, wherein said lock means comprises a lock member and a lock actuator for moving said lock member between said lock and unlock positions, and said safety means comprises a block member and a block actuator for moving said block member between said block and unblock positions;

said door lock system further comprising switch means for producing signals to operate said lock actuator and said block actuator, wherein said block actuator comprises a drive member and a driven member which is driven by said drive member and connected with said block member, said block actuator being irreversible so that said drive member can drive said driven member but said driven member cannot drive said drive member, and wherein said lock actuator comprises a drive member and a driven member which is driven by said drive member and connected with said lock member, said lock actuator being reversible so that said driven member of said lock actuator can drive said drive member of said lock actuator;

switch means for producing signals to operate said lock and block actuators, said switch means comprising a key lock switch which is connected with a key cylinder for producing a key lock command signal and a key unlock command signal when a key is inserted and moved in said key cylinder;

said switch means includes means for causing said lock actuator to move said lock member to said lock position and said block actuator to move said block member to said block position when said key lock command signal is produced, and causing said block actuator to move said block member to said unblock position and said lock actuator to move said lock member to said unlock position when said key unlock command signal is produced;

said switch means further comprising a power lock switch mounted near a driver's seat of said vehicle, for producing a power lock command signal and a power unlock command signal to operate said lock actuator;

wherein said block member is connected with said lock means so that said block member can move from said unblock position to said block position only when said lock means is in said lock position;

said switch means further comprising a lock detector which produces a lock detection signal when said lock means is in said lock position and an unlock detection signal when said lock means is in said unlock position, a block detector which produces a block detection signal when said safety means is in said block position and an unblock detection signal when said safety means is in said unblock position, first logic means which produces a block actuation signal to cause said block actuator to move said block member to said block position only when said key block command signal and said lock detection signal are both present, and second logic means which produces an unlock actuation signal to cause said lock actuator to move said lock member to said unlock position only when said key unlock command signal and unblock detection signal are both present;

wherein said lock member is a lever swingable between said lock and unlock positions about a first swing axis, and said block member is a lever swingable between said block and unblock positions about a second swing axis, said block member having a slot in which said first end of said lock member is slidably engaged, said slot including a first slot section extending from an unlock end to a lock end, and a second slot section extending from said lock end of said first slot section to a block end, said first slot section being shaped so that, when said block member is in unblock position, said fist end of said lock member can swing along said first slot section about said first swing axis, the second slot section being shaped like the arc of a circle whose center lies on said second swing axis, said first end of said lock member being located at said lock end of said first slot section when said lock member is in said lock position and said block member is in said unblock position;

the switch means further comprising a third logic means which produces said unlock actuation signal to cause said lock actuator to move said lock member to said unlock position only when said power unlock command signal and said unblock detection signal are both present.

2. A system according to claim 1 wherein said switch means further comprises a safety lock switch for producing a block command signal and an unblock command signal, and fourth logic means which produces said block actuation signal only when said block command signal and said lock detection signal are both present.

3. A system according to claim 2 wherein said switch means further comprises memory means which is set in a disabling state when said key lock command signal is produced, and held in said disabling state until said memory means is reset to an enabling state when said key unlock signal is produced, said switch means further comprising fifth logic means which produces an unblock actuation signal to cause said block actuator to move said block member from said block position to said unblock position only when said memory means is in said enabling state and said unblock command signal is present, said fifth logic means being unable to produce said unblock detection signal when said memory means is in said disabling state.

4. A system according to claim 3 wherein said switch means further comprises emergency unlock means which causes said block actuator to move said block member to said unblock position and said lock actuator to move said lock member to said unlock position in case of an emergency of the vehicle.

5. A system according to claim 4 wherein said block actuator comprises a drive member and a driven member which is driven by said drive member and connected with said block member, said block actuator being irreversible so that said drive member can drive said driven member but said driven member cannot drive said drive member, and wherein said lock actuator comprises a drive member and a driven member which is driven by said drive member and connected with said lock member, said lock actuator being reversible so that said driven member of said lock actuator can drive said drive member of said lock actuator.

6. A vehicle door system comprising:

lock means for locking and unlocking a door of a vehicle, said lock means being movable between a lock position to lock the door and an unlock position to unlock the door; and safety means which prevents said lock means from moving from said lock position to said unlock position when said safety means is in a block position, and which allows said lock means to move from said lock position to said unlock position when said safety means is in an unblock position, wherein said lock means comprises a lock member and a lock actuator for moving said lock member between said lock and unlock positions, and said safety means comprises a block member and a block actuator for moving said block member between said block and unblock positions, said door lock system further comprising switch means for producing signals to operate said lock actuator and said block actuator, wherein said block actuator comprises a drive member and a driven member which is driven by said drive member and connected with said block member, said block actuator being irreversible so that said drive member can drive said driven member but said driven member cannot drive said drive member, and wherein said lock actuator comprises a drive member and a driven member which is driven by said drive member and connected with said lock member, said lock actuator being reversible so that said driven member of said lock actuator can drive said drive member of said lock actuator; wherein each actuator comprises a drive member in the form of a threaded rod which has a screw thread, and which moves said driven member forwardly when said drive member rotates in a first rotational direction, and moves said driven member backwardly when said drive member rotates in a second rotational direction said screw thread of said drive member of said lock actuator having a pitch angle that is greater than that of said block actuator; and switch means for producing signals to operate said lock and block actuators, said switch means including means for causing said lock actuator to move said lock member to said lock position and said block actuator to move said block member to said block position when said key lock command signal is produced, and causing said block actuator to said block member to said unblock position and said lock actuator to move said lock member to said unlock position when said key unlock command signal is produced; said switch means further comprising a key lock switch which is connected with a key cylinder and which produces a key lock command signal and a key unlock command signal when a key is inserted and moved in said key cylinder.

7. A system according to claim 6 wherein said lock actuator further comprises an electric motor for driving said drive member and a centrifugal clutch interposed between said motor and said drive member, and said block actuator further comprises an electric motor which directly drives said drive member.

8. A system according to claim 7 wherein said lock means further comprises an inside lock knob, and a connecting rod having a first end connected with said lock knob, and a second end directly connected with said first end of said lock lever.

9. A vehicle door system comprising:

lock means for locking and unlocking a door of a vehicle, said lock means being movable between a lock position to lock the door and an unlock position to unlock the door; and safety means which prevents said lock means from moving from said lock position to said unlock position when said safety means is in a block position, and which allows said lock means to move from said lock position to said unlock position when said safety means is in an unblock position, wherein said lock means comprises a lock member and a lock actuator for moving said lock member between said lock and unlock positions, and said safety means comprises a block member and a block actuator for moving said block member between said block and unblock positions, said door lock system further comprising switch means for producing signals to operate said lock actuator and said block actuator, wherein said block actuator comprises a drive member and a driven member which is driven by said drive member and connected with said block member, said block actuator being irreversible so that said drive member can drive said driven member but said driven member cannot drive said drive member, and wherein said lock actuator comprises a drive member and a driven member which is driven by said drive member and connected with said lock member, said lock actuator being reversible so that said driven member of said lock actuator can drive said drive member of said lock actuator; and switch means for producing signals to operate said lock and block actuators, said switch means comprising a key lock switch which is connected with a key cylinder and which produces a key lock command signal and a key unlock command signal when a key is inserted and moved in said key cylinder, said switch means including means for causing said lock actuator to move said lock member to said lock position and said block actuator to move said block member to said block position when said key lock command signal is produced, and causing said block actuator to move said block member to said unblock position and said lock actuator to move said lock member to said unlock position when said key unlock command signal is produced;

said switch means further comprising a power lock switch, mounted near a driver's seat of a vehicle, for producing a power lock command signal and a power unlock command signal to operate said lock actuator; wherein said block member is connected with said lock means so that said block member can move from said unblock position to said block position only when said lock means is in said lock position;

said switch means further comprising a lock detector which produces a lock detection signal when said lock means is in said lock position, and an unlock detection signal when said lock means is in said unlock position, a block detector which produces a block detection signal when said safety means is in said block position and an unblock detection signal when said safety means is in said unblock position, first logic means which produces a block actuation signal to cause said block actuator to move said block member to said block position only when said key block command signal and said lock detection signal are both present, and second logic means which produces an unlock actuation signal to cause to cause said lock actuator to move said lock member to said unlock position only when said key unlock command signal and said unblock detection signal are both present;

wherein said lock member is a lever swingable between said lock and unlock position about a first swing axis, and said block member is a lever swingable between said block and unblock positions about a second swing axis, said having a slot in which a first end of said lock member is slidably engaged, said slot including a first slot section extending from an unlock end to a lock end, and a second slot section extending from said lock end of said first slot section to a block end, said first slot section being shaped so that, when said block member is in said unblock position, said first end of said lock member can swing along said first slot section about said first swing axis, said second slot section being shaped like an arc of a circle whose center lies on said second swing axis, said first end of said lock member being located at said lock end of said first slot section when said lock member is in said lock position and said block member is in said unblock position;

wherein said slot of said block member includes a third slot section extending from said unlock end of said first slot section, said third slot section being shaped like an arc of a circle whose center lies on said second swing axis, wherein said switch means further comprises a key detector for producing a key detection signal when said key is present in an ignition key cylinder of the vehicle, a door position detector for producing a door opening detection signal when the door is open, and logic means for producing a block actuation signal to cause said block actuator to move said block member from said unblock position, toward said block position when said key detection signal and said door opening detection signal are both present.

10. A vehicle door system comprising:

lock means for locking and unlocking a door of a vehicle, said lock means being movable between a lock position to lock the door and an unlock position to unlock the door; and safety means which prevents said lock means from moving from said lock position to said unlock position when said safety means is in a block position, and which allows said lock means to move from said lock position to said unlock position when said safety means is in an unblock position, wherein said lock means comprises a lock member and a lock actuator for moving said lock member between said lock and unlock positions, and said safety means comprises a block member and a block actuator for moving said block member between said block and unblock positions, said door lock system further comprising switch means for producing signals to operate said lock actuator and said block actuator, wherein said block actuator comprises a drive member and a driven member which is driven by said drive member and connected with said block member, said block actuator being irreversible so that said drive member can drive said driven member but said driven member cannot drive said drive member, and wherein said lock actuator comprises a drive member and a driven member which is driven by said drive member and connected with said lock member, said lock actuator being reversible so that said driven member of said lock actuator can drive said drive member of said lock actuator; and switch means for producing signals to operate said lock and block actuators, said switch means comprising a key lock switch which is connected with a key cylinder and which produces a key lock command signal and a key unlock command signal when a key is inserted and moved in said key cylinder, wherein, in each actuator, said drive member is a threaded rod which has a screw thread, and which moves said driven member forwardly when said driven member rotates in a first rotational direction, and moves said driven member backwardly when said drive member rotates in a second rotational direction, said screw thread of said drive member having a pitch angle which is greater than that of said block actuator.

11. A system according to claim 10 wherein said switch means includes means for causing said lock actuator to move said lock member to said lock position and said block actuator to move said block member to said block position when said key lock command signal is produced, and causing said block actuator to move said block member to said unblock position and said lock actuator to move said lock member to said unlock position when said key unlock command signal is produced.

12. A system according to claim 11 wherein said switch means further comprises a power lock switch, mounted near a driver's seat of said vehicle, for producing a power lock command signal and a power unlock command signal to operate said lock actuator.

13. A system according to claim 12 wherein said block member is connected with said lock means so that said block member can move from said unblock position to said block position only when said lock means is in said lock position.

14. A system according to claim 13 wherein said switch means further comprises a lock detector which produces a lock detection signal when said lock means is in said lock position, and an unlock detection signal when said lock means is in said unlock position, a block detector which produces a block detection signal when said safety means is in said block position and an unblock detection signal when said safety means is in said unblock position, first logic means which produces a block actuation signal to cause said block actuator to move said block member to said block position only when said key block command signal and said lock detection signal are both present, and second logic means which produces an unlock actuation signal to cause said lock actuator to move said lock member to said unlock position only when said key unlock command signal and said unblock detection signal are both present.

15. A system according to claim 14 wherein said lock member is a lever swingable between said lock and unlock position about a first swing axis, and said block member is a lever swingable between said block and unblock positions about a second swing axis, said block member having a slot in which a first end of said lock member is slidably engaged, said slot including a first slot section extending from an unlock end to a lock end, and a second slot section extending from said lock end of said first slot section to a block end, said first slot section being shaped so that, when said block member is in said unblock position, said first end of said lock member can swing along said first slot section about said first swing axis, said second slot section being shaped like an arc of a circle whose center lies on said second swing axis, said first end of said lock member being located at said lock end of said first slot section when said lock member is in said lock position and said block member is in said unblock position.

16. A system according to claim 10 wherein said lock actuator is electrically connected with said switch means so that said lock actuator can move said lock member in response to an electric signal produced by said switch means, and said block actuator is electrically connected with said switch means so that said block actuator can move said block member in response to an electric signal produced by said switch means.

17. A system according to claim 10 wherein said lock actuator further comprises an electric motor for driving said drive member of said lock actuator and said block actuator further comprises an electric motor for driving said drive member of said block actuator.

18. A system according to claim 17 wherein said lock actuator further comprises a centrifugal clutch interposed between said motor of said lock actuator and said drive member of said lock actuator.

19. A system according to claim 10 wherein said switch means comprises a key lock switch which is connected with a key cylinder and which produces a key lock command signal and a key unlock command signal when a key is inserted and moved in said key cylinder.

* * * * *